United States Patent [19]

Fujimori et al.

[11] Patent Number: 4,742,462

[45] Date of Patent: May 3, 1988

[54] APPARATUS FOR CONTROLLING IDLING OPERATION OF AN INTERNAL COMBUSTION ENGINE

[75] Inventors: Kyoichi Fujimori; Akira Sekiguchi, both of Higashimatsuyama, Japan

[73] Assignee: Diesel Kiki Co., Ltd., Japan

[21] Appl. No.: 779,222

[22] Filed: Sep. 23, 1985

[30] Foreign Application Priority Data

| | | | |
|---|---|---|---|
| Sep. 22, 1984 | [JP] | Japan | 59-197779 |
| Mar. 12, 1985 | [JP] | Japan | 60-047409 |
| Mar. 12, 1985 | [JP] | Japan | 60-047410 |
| Mar. 12, 1985 | [JP] | Japan | 60-047411 |
| Mar. 12, 1985 | [JP] | Japan | 60-047412 |
| Mar. 12, 1985 | [JP] | Japan | 60-047413 |

[51] Int. Cl.[4] ..... F02D 1/02; F02D 41/16; F02M 51/00

[52] U.S. Cl. ..... 364/431.08; 123/339; 364/431.07

[58] Field of Search ..... 364/431.07, 431.08; 123/339, 419, 436

[56] References Cited

U.S. PATENT DOCUMENTS

| | | | |
|---|---|---|---|
| 4,475,511 | 10/1984 | Johnson et al. | 123/436 |
| 4,476,833 | 10/1984 | Johnson et al. | 123/436 |
| 4,495,920 | 1/1985 | Matsumura et al. | 123/436 |
| 4,509,477 | 4/1985 | Takao et al. | 123/436 X |
| 4,535,406 | 8/1985 | Johnson | 364/431.08 |
| 4,552,113 | 11/1985 | Williams | 123/436 |
| 4,603,668 | 8/1986 | Ueno | 123/339 X |
| 4,635,201 | 1/1987 | Izumi | 364/431.07 |
| 4,644,475 | 2/1987 | Koyanagi | 364/431.07 |

FOREIGN PATENT DOCUMENTS 140065 5/1985 European Pat. Off. .

*Primary Examiner*—Felix D. Gruber
*Attorney, Agent, or Firm*—Guy W. Shoup

[57] ABSTRACT

An idling operation control apparatus consists of a closed-loop control system responsive to an average speed of a multi-cylinder internal combustion engine for obtaining a target idling engine speed. In the closed-loop control system, there is provided an individual cylinder control system in which a first data relating to outputs of respective cylinders of the engine is produced in response to an operation timing of the engine and the differential data showing the difference between the output of the respective cylinder and the output of a reference cylinder is calculated on the basis of the first data. A second control data relating to the fuel amount necessary for nullifying the difference indicated by the differential data is also produced in the latter system and the second data is supplied to the closed-loop control system, whereby the difference among the outputs of the cylinder is reduced.

17 Claims, 10 Drawing Sheets

APPARATUS FOR CONTROLLING IDLING OPERATION OF AN INTERNAL COMBUSTION ENGINE

BACKGROUND OF THE INVENTION

The present invention relates to an idling operation control apparatus for an internal combustion engine, more particularly to an idling operation control apparatus adapted to regulate fuel to be supplied for every cylinder so as to minimize the dispersion of the output from each cylinder of a multiple cylinder engine.

In the control of the amount of fuel injection of the multiple cylinder engine according to the prior art, the fuel injection amount is uniformly controlled for all the cylinders in common. Accordingly, the output from each of the cylinders was not equal due to differences within the manufacturing tolerance of the internal combustion engine and/or the fuel injection pump and the like.

In particular, non-uniform output of the cylinders causes striking degradation in the stability of the engine during the idling operation of the engine, and this in turn increases engine vibrations and the amount of harmful components included in the exhaust gas. In addition, disadvantages such as noise are generated by the vibration of the engine.

In order to overcome the above disadvantages, there have been proposed various apparatuses for respectively controlling the fuel to be injected into each cylinder of the engine according to an individual cylinder control system. Some examples of the apparatuses of the type are disclosed in U.S. Pat. No. 4,495,920 in which a target average engine speed value is calculated by sampling the engine speeds at an integer multiple of the number of cylinders and the control of the amount of fuel injection is carried out for each cylinder on the basis of the difference between the engine speed of each cylinder and the target value thus calculated, utilizing a "learning system."

In each of the control apparatuses according to the prior art, however, since the following fuel injection amount was predicted from the difference between the average engine speed and the instantaneous speed of each cylinder by the learning system, much time is required by the microprocessor in evaluating the result of the learning. As a result, the control response is not good. In addition, a complicated algorithm has been necessary in order to evaluate the result of the learning, thus creating the problem of many procedures being necessary for the development thereof.

Furthermore, it is necessary for such a control to detect the timing of the combustion stroke of each cylinder, and in the conventional device, the timing was detected on the basis of a signal from a sensor which electrically detects the timing of the opening of a fuel injection valve and a signal from a reference timing sensor mounted on the crankshaft of the engine.

However, the above-described construction renders detection of the timing of the fuel injection impossible and appropriate control cannot be continued if the crankshaft sensor malfunctions. As a result, in this case, the individual cylinder control system causes instability in the operation of the engine.

SUMMARY OF THE INVENTION

It is therefore an object of the present invention to provide an improved apparatus for controlling the idling operation of an internal combustion engine.

It is another object of the present invention to provide an apparatus for controlling the idling operation of an internal combustion engine in which no complicated algorithms are required to evaluate the control result and the idling operation can be performed with high response by a closed loop control system in accordance with the output difference from the cylinders of the multiple cylinder internal combustion engine.

It is a further object of the present invention to provide an apparatus for controlling the idling operation of an internal combustion engine in which the timing required for the control of each cylinder can be distinguished on the basis of only the output from a sensor for detecting the rotational timing of the engine to improve the reliability of the system.

It is still another object of the present invention to provide an apparatus for controlling the idling operation of an internal combustion engine according to the individual cylinder control system in which the idling operation can stably be performed with less fuel consumption.

It is a still further object of the present invention to provide an apparatus for controlling the idling operation of an internal combustion engine according to the individual cylinder operation system in which engine vibration with a high frequency component can be further decreased.

It is a still further object of the present invention to provide an apparatus for controlling the idling operation of an internal combustion engine in which the time required for attaining a settled state of individual cylinder control operation after the start of the individual cylinder control operation is shortened.

According to the present invention, in an apparatus for controlling the idling operation of an internal combustion engine consisting of a closed-loop control system having a first output means for producing an average speed data indicating an average engine speed of a multi-cylinder internal combustion engine, a second output means for producing a target speed data indicating a predetermined target idling engine speed, a first calculating means responsive to the average speed data and the target speed data for producing a first control data relating to the fuel amount to be supplied to the engine so as to obtain the target idling engine speed, and a controlling means responsive to the first control data for controlling a speed regulating means so as to carry out the closed loop control for the idling engine speed, an apparatus comprising a detecting means for detecting operation timing of said engine, a first means responsive to the detected result of the detecting means for producing a first data relating to the output of the respective cylinders of the engine, a second means responsive to the first data for repeatedly calculating and producing differential data relating to the cylinders successively, the differential data being indicative of the difference between the output of the respective cylinders and the output of a reference cylinder which is predetermined for the respective cylinders, a second calculating means responsive to the differential data for calculating and producing a second control data relating to the fuel amount required for nullifying the indicated difference of the differential data, an output control means responsive to the result from the detecting means for outputting the second control data at a predetermined time before the ensuing regulation of fuel going to each of the cylinders, and a third means for supplying the second control data to the closed-loop control system.

With the construction described above, a second feedback control loop for controlling fuel quantity so as to reduce to zero the differences among the outputs of the cylinders is provided in a first feedback control loop for controlling the engine speed in such a way that the average engine speed is equal to the desired idling engine speed. In cooperation with these two feedback control loops, the amount of the change in the angular speed of the engine can be regulated so as to be constant, so that the magnitude of the vibration produced in the engine can be reduced. Further, it is possible to reduce the engine noise level and idling speed.

The second feedback control loop may be formed only when the conditions of the engine operation satisfy predetermined criteria. For example, the coolant temperature may be selected as such a condition. In this case, when the coolant temperature is less than a predetermined value at which fuel combustion in each cylinder is liable to become unstable, the output of the second control data is stopped to halt the individual cylinder control operation at such low temperature condition. This prevents idling operation becoming unstable in low temperature condition due to the individual cylinder control operation.

Further, when the individual cylinder control operation is carried out by the formation of the second feedback control loop, the target injection advance may be changed so as to reduce the high frequency noise component and the fuel consumption.

In addition, since more stable idling engine operation can be realized by the use of the second feedback control loop, when the second feedback control loop is formed, the target idling engine speed may be lower to improve the fuel consumption.

In the case where the individual cylinder control operation is turned ON or OFF, it is desired to shorten the transient time between the time the control loop for the individual cylinder control system is formed and the time the control condition of the individual cylinder control system reaches a settled condition. According to this invention, in order to perform at least the proportional and integral control, processing means for processing the required control data is provided in the second feedback control loop. When the control for each cylinder is turned OFF, the integral value data for the integral control obtained by the processing means is retained and when the control for each cylinder is turned ON, the integral value data which has been retained is now supplied to the processing means as initial data for the integral control. Accordingly, when the control for each cylinder is resumed, the transient time at the start of the individual cylinder control operation will be shortened.

The invention will be better understood and other objects and advantages thereof will be more apparent from the following detailed description of preferred embodiments with reference to the accompanying drawings.

DESCRIPTION OF THE PREFERRED EMBODIMENTS

Figure 1A:
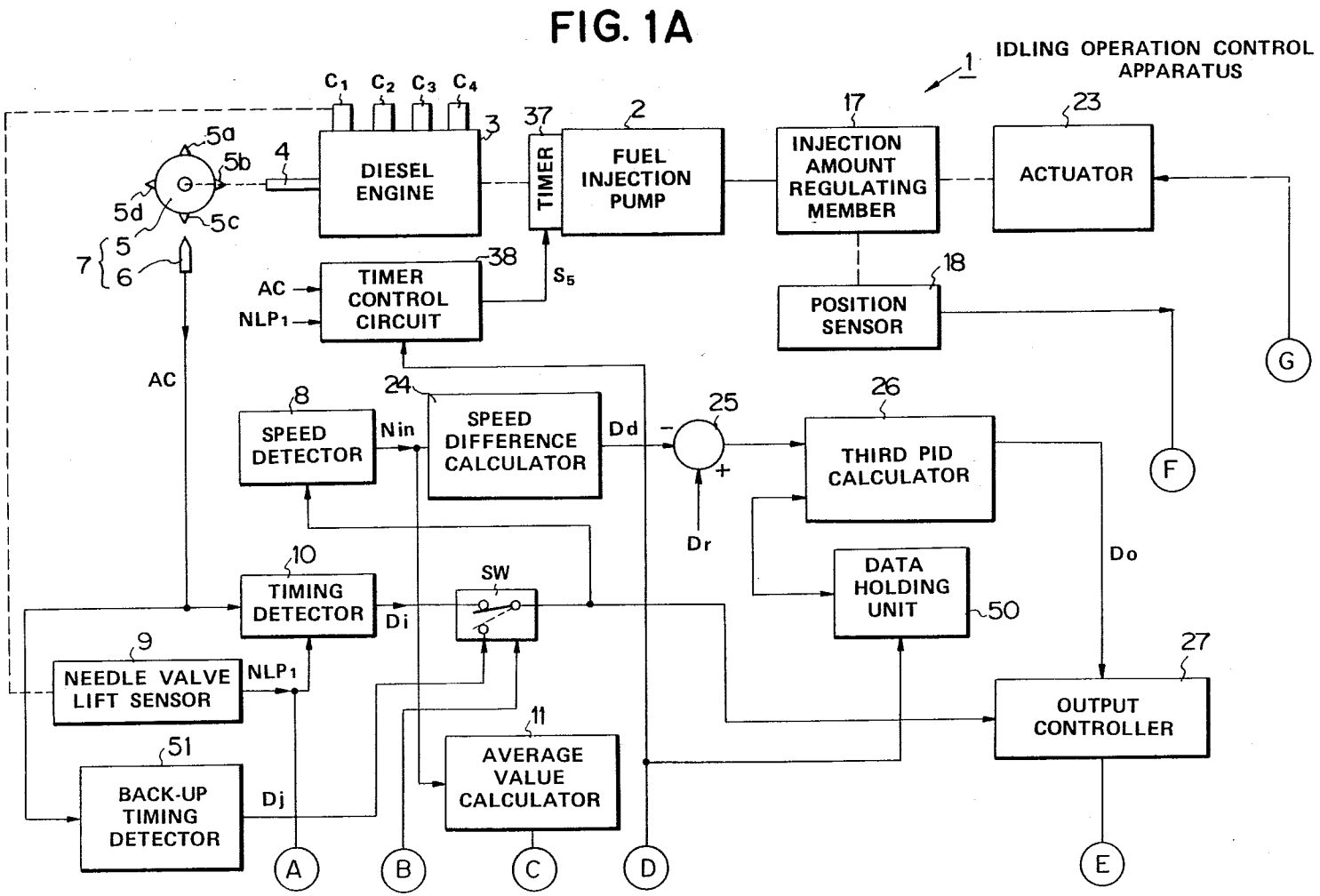
FIGS. 1A and 1B taken together are a block diagram of an embodiment of the present invention.
Figure 1B:
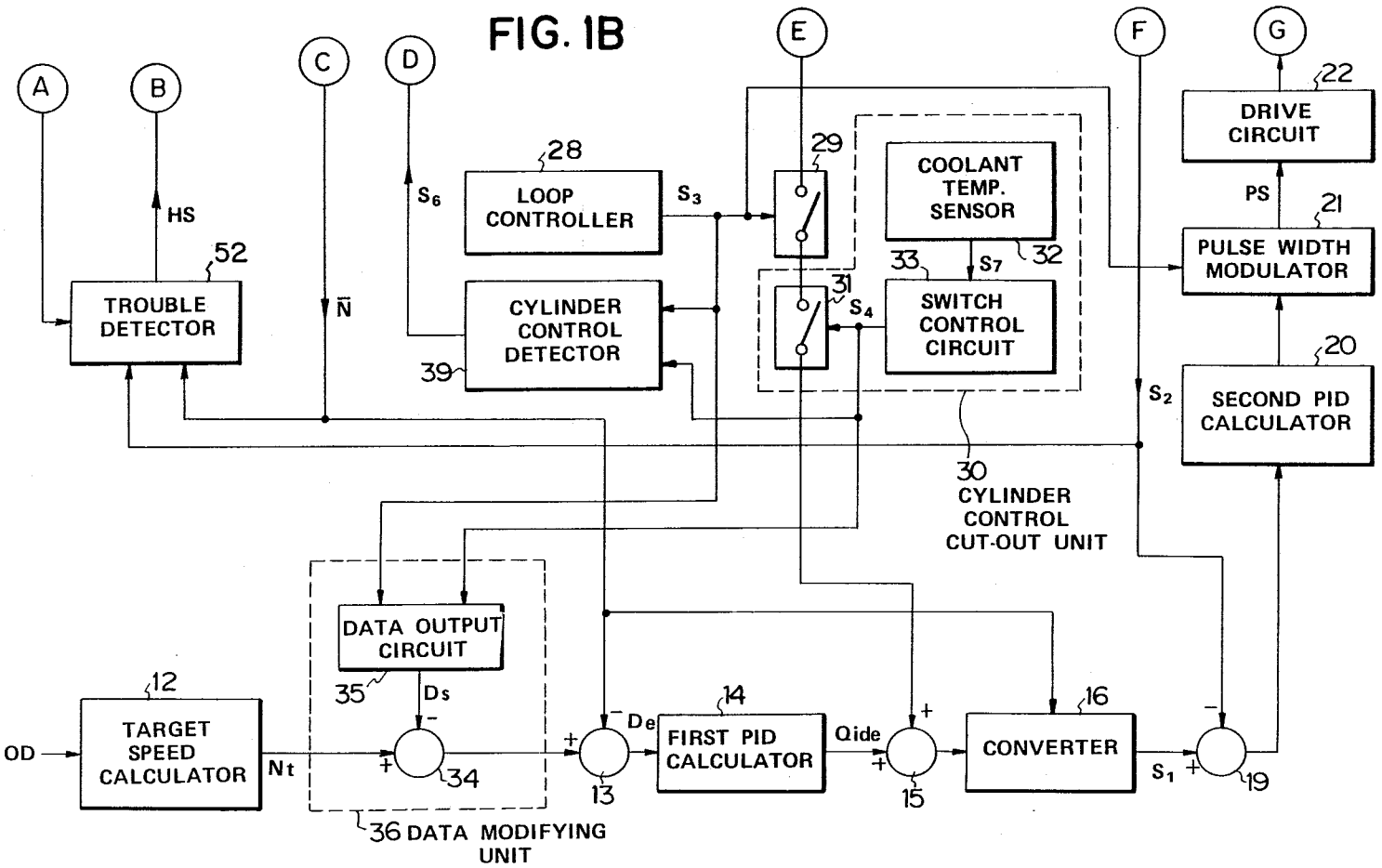

FIG. 1 is a block diagram of an idling operation control apparatus for an internal combustion engine according to the present invention, as applied to idling operation control of a diesel engine. A diesel engine 3 is supplied with fuel by injection from a fuel injection pump 2, and the idling operation control apparatus 1 serves to control the speed of rotation of the engine 3 during idling and the fuel injection advance angle.

A rotation sensor 7 is provided to detect when the crankshaft 4 of the diesel engine 3 has reached a predetermined reference position. The rotation sensor 7 is of a known design, consisting of a pulser 5 and an electromagnetic pick-up coil 6. Since the diesel engine 3 is of the four-cycle four-cylinder type in the embodiment shown in FIG. 1, a set of cogs, 5*a* to 5*d*, is formed around the periphery of pulser 5, one cog each 90°. The relative positional relationships between pulser 5 and crankshaft 4 are established in such a way that when the pistons in two of the four cylinders of diesel engine 3 reach the top dead center position, cog 5*a* or 5*c* is disposed immediately opposite electromagnetic pick-up 6.

Figures 2A, 2B, 2C, 2D, 2E, 2F, 2G:
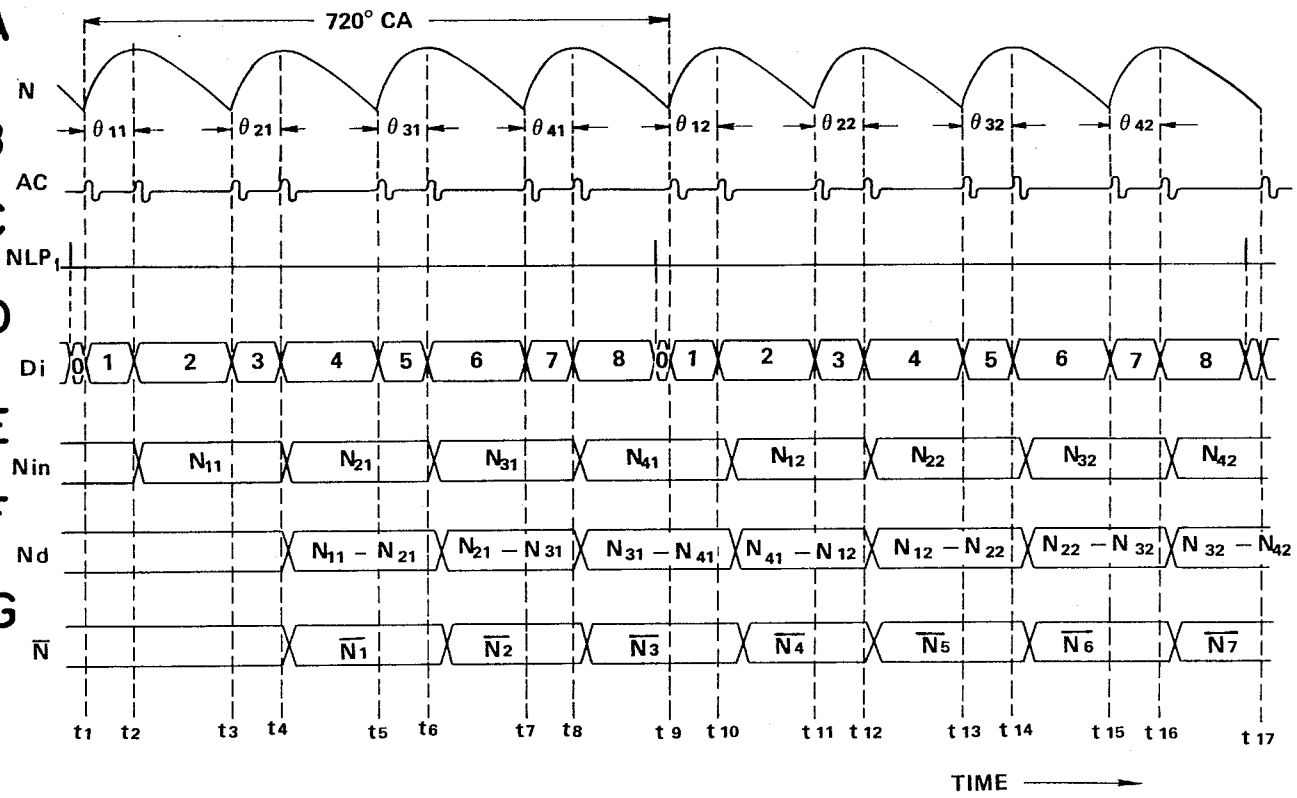
FIGS. 2A to 2G are time charts for explaining the operation of the apparatus shown in FIG. 1.

FIG. 2A shows the instantaneous speed of rotation of diesel engine 3, and FIG. 2B shows the waveforms of an a.c. signal designated as AC which is produced by rotation sensor 7. Each time a cog becomes positioned opposite electromagnetic pick-up coil 6, the a.c. signal AC changes in level from positive to negative polarity, so that a waveform made up of pairs of pulses each comprising a positive pulse followed by a negative pulse is produced. The timings $t_1, t_3, t_5, \ldots t_{17}$ of the zero-crossover points between each of these positive and negative peaks correspond to the top dead center timings of the pistons in diesel engine 3. Timings $t_2, t_4, \ldots t_{16}$ correspond to the indicated timings at which the crankshaft 4 has rotated through an angle which is greater than 90°, after passing the top dead center position. On the other hand, the timings $t_1, t_3, t_5, \ldots t_{17}$ of the minimum points of the instantaneous rotational speed N are the combustion start timings of the cylinders. This is due to the fact that as combustion occurs the instantaneous rotational speed begines to increase. On the other hand, at each of the timings $t_2$, $t_4$, . . . $t_{16}$, the instantaneous rotational speed N begines to decrease. Just prior to each of the successive timings at which ignition takes place, the instantaneous rotation speed N reaches a minimum value. For this reason, the instantaneous rotational speed N of diesel engine 3 varies in a periodic manner, with the period of this variation corresponding to ½ of a full rotation of crankshaft 4.

Strictly speaking, in some cases the minimum points of the instantaneous rotational speed N may not correspond to the top dead center positions of the pistons during compression within the cylinders and the maximum points may not also correspond to the points delayed from the top dead center by 90°. However, for ease of description, it will be assumed in the following that the minimum points do correspond to the top dead center points and the maximum points to the points delayed from the top dead center by 90°.

The four cylinders of diesel engine 3 will be designated as cylinders $C_1$, $C_2$, $C_3$ and $C_4$ respectively, with the combustion process being initiated for cylinders $C_1$ to $C_4$ at timings $t_1$, $t_3$, $t_5$ and $t_7$ respectively. In the follwing description, this sequence of combustion start timings for the cylinders will be assumed.

The relationships between the rising-up points of a.c. signal AC, i.e., the timings which are indicated by these rising-up points and the timings of the respective cylinders, are detected as follows. A needle valve lift pulse signal $NLP_1$ is produced from a needle valve lift sensor 9 of a fuel injection valve (not shown) which is mounted on cylinder $C_1$, and is input to timing detector 10 as a reference timing signal. As shown in FIG. 2C, the needle valve lift pulse signal $NLP_1$ is output just prior to each of the combustion start timings of the cylinder $C_1$, i.e., at timings $t_1$, $t_9$, $t_{17}$. The timing detector 10 is composed mainly of a binary counter which counts input pulses in correspondence with the positive-going pulses of a.c. signal AC, and is reset by the needle valve lift pulse signal $NLP_1$. Binary data representing the results of this counting are output as discrimination data $D_i$. In this way, it is possible easily to distinguish the correspondence between any arbitrary rising-up point of a.c. signal AC and the cylynder having a corresponding operation timing. The discrimination data $D_i$ is output through a changeover switch SW (described in the following) to be input to a speed detector 8.

Figure 3:
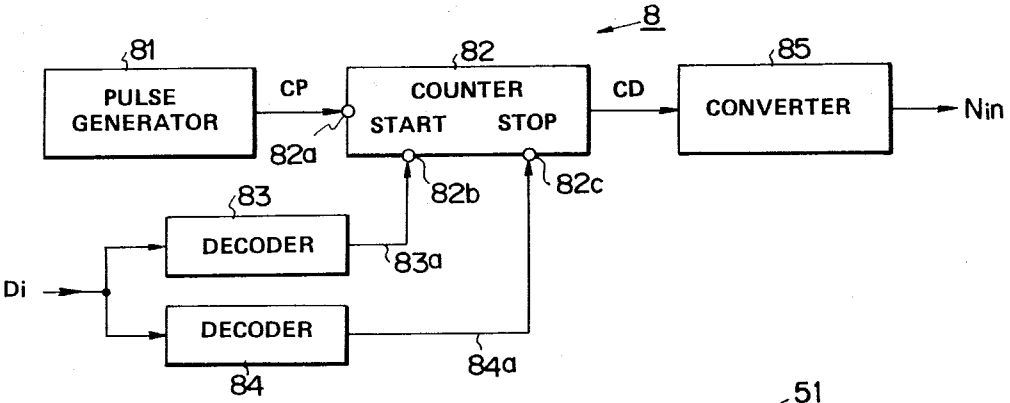
FIG. 3 is a detailed block diagram of the speed detector shown in FIG. 1.

The speed detector 8 serves to measure the time intervals $\theta_{11}$, $\theta_{21}$, . . . $\theta_{41}$, $\theta_{12}$, $\theta_{22}$, . . . which are required for crankshaft 4 to rotate through 90° following the combustion start timing in each cylinder, the measurement being performed on the basis of a.c. signal AC. FIG. 3 is a circuit diagram of a specific example of the speed detector 8. As shown in FIG. 3, speed detector 8 includes a pulse generator 81, which outputs count pulses CP generated at a constant frequency which is higher than that of a.c. signal AC. The speed detector 8 also includes a counter 82, for counting the number of the pulses CP. Counter 82 is provided with an input terminal 82*a* for receiving count pulses CP, a start terminal 82*b* for receiving start pulses, which is used to reset the counter 82 and to start counting operations, and a stop terminal 82*c* for receiving stop pulses. These stop pulses act to halt counting operations by counter 82, and to hold the count contents unchanged. Output lines 83*a* and 84*a* of decoders 83 and 84 respectively are connected to the terminals 82*b* and 82*c* respectively, and the discrimination data $D_i$ is applied to decoders 83 and 84.

As described in the above, the discrimination data $D_i$ expresses a count value of a number of positive-going pulses within a.c. signal AC, with the pulse counting being performed by a counter which is reset by the needle valve lift pulse signal $NLP_1$. In the embodiment shown in the drawing, timing detector 10 is constructed in such a way that the discrimination data $D_i$ is set to zero when timing detector 10 is reset by signal $NLP_1$. Thus, as shown in FIG. 2D, the contents of discrimination data $D_i$ will be 1 at timing $t_1$, 2 at timing $t_2$, and 3 at timing $t_3$, i.e., discrimination data $D_i$ is incremented by one each time a positive-going pulse of a.c. signal AC is generated, and thus reaches a value of 8 at time $t_8$. Immediately prior to timing $t_9$, discrimination data $D_i$ is reset to zero by the application of the needle valve lift pulse signal $NLP_1$. Subsequently, the contents of discrimination data $D_i$ will once more sequentially change as described above.

Each time the contents of discrimination data $D_i$ attain any of the values 1, 3, 5 or 7, the level of output line 83*a* of the decoder 83 will go high for a short time to apply a start pulse to the start terminal 82*b* of the counter 82. On the other hand, when the contents of discrimination data $D_i$ reach any of the values 2, 4, 6 or 8, the output line 84*a* of the decoder 84 goes to high for a short time, and as a result, a stop pulse is applied to the stop terminal 82*c* of the counter 82.

Thus, the counter 82 counts the clock pulses CP following each of the combustion start timings ($t_1$, $t_3$, $t_5$, . . . ) during an interval which extends until the crankshaft 4 has rotated through 90°. The counter 82 thereby produces as output the count data CD, which corresponds to one of the intervals $\theta_{11}$, $\theta_{21}$, . . . $\theta_{41}$, $\theta$12, . . . . The count data CD is applied to a converter 85 and the count data CD is thereby converted into data representing each of the time intervals $\theta_{11}$, $\theta_{21}$, . . . . This converted data is output sequentially as instantaneous speed of rotation, which expresses the engine's instantaneous speed of rotation immediately following combustion in a cylinder.

As described in the above, data expressing each of the time intervals $\theta_{11}$, $\theta_{21}$, . . . , each of which extends from a zero-crossover point of a.c. signal AC (corresponding to the combustion start timings for the engine cylinders) until the succeeding zero-crossover point timing, are output from the speed detector 8. In the following, the instantaneous speed data which expresses the instantaneous rotational speed with respect to cylinder $C_i$ will be expressed in terms of a sequence in which detection is performed by speed detector 8, that is to say, in the general form $N_{in}$ (where n = 1, 2, . . . ).

The contents of instantaneous speed data $N_{in}$ output from the speed detector 8 will therefore be as shown in FIG. 2E.

The instantaneous speed data $N_{in}$ is input to an average value calculator 11, whereby the average speed of the diesel engine 3 is calculated. Numeral 12 denotes a target speed calculator, which calculates a target idling rotation speed on the basis of the operating status of the diesel engine 3 at each instant, and produces target speed data $N_t$ showing the results of this calculation. Target speed calculator 12 has a well-known type of configuration, in which target speed data $N_t$ is produced to indicate the optimum speed of idling rotation, based on the operating status of the diesel engine 3 as expressed by predetermined operating data OD for the diesel engine 3. Thus, no detailed description of the configuration of the target speed calculator 12 will be given herein. In this case, instead of using target speed calculator 12, it is equally possible to employ a configuration whereby constant data, determined on the basis of a requisite target speed, are produced. Thus, the circuit configuration for producing target speed data $N_t$ is not limited to that shown in FIG. 1.

The target speed data $N_t$ is input to a data modifying unit 36, which serves to compensate the target data in accordance with conditions described hereinafter, such as to provide idling speed data which is lower than the target speed data $N_t$ by a specific fixed value. The data thus produced from the data modifying section is input to an adder 13. The average speed data $\overline{N}$ output from the average value calculator 11 is also input to adder 13, whereby the average speed data $\overline{N}$ and target speed data $N_t$ are added together, with the polarities shown in the drawing. The result of this addition is input, as error data $D_e$, to a first PID (Proportional Integrational and Differential) calculator 14, in which data processing for PID control is carried out.

The results of the calculation from the first PID calculator 14 are output as the injection amount dimension data $Q_{ide}$, which is transferred through an adder 15 to be input to a converter 16. The average speed data $\overline{N}$ is also input to the converter 16. In this way, data $Q_{ide}$ is converted into a target position signal $S_1$, which expresses a target value for the position of an injection amount regulating member 17, i.e., a value for this position which is such as to bring the error data $D_e$ to zero. A position sensor 18 serves to detect the successive positions to which injection amount regulating member 17 is set, in order to enable adjustment of the amounts of fuel injected by fuel injection pump 2. For this purpose, a position sensor 18 produces as output an actual position signal $S_2$, which indicates the position at which the injection amount regulating member 17 is currently set. This actual position signal $S_2$ is added to the target position signal $S_1$ from converter 16 by the adder 19 with the polarities shown in the drawing.

The addition output signal from adder 19 is input to a second PID calculator 20, and after signal processing to execute PID control, the signal from the second PID calculator 20 is input to pulse width modulator 21. As a result, pulse width modulator 21 produces a pulse signal PS which has a duty ratio determined in accordance with the output from the second PID calculator 20. Pulse signal PS is applied through a drive circuit 22 to an actuator 23, for controlling the position of the injection amount regulating member 17. In this way, the injection amount regulating member 17 implements position control such that the diesel engine 3 attains idling operation at the target idling engine speed.

By means of the closed loop control system described above, which responds to the average engine speed and to the actual position of the injection amount regulating member 17, the rotation of diesel engine 3 is controlled so that it coincides with the predetermined idling speed.

The apparatus 1 also comprises another closed loop control system, for implementing control of individual cylinders, i.e., the "individual cylinder control", whereby an identical output is produced from each of the cylinders of the diesel engine 3. This closed loop control system will now be described.

The closed loop control system for individual cylinder control acts to adjust the fuel supplied to each of the cylinders in a manner which tends to reduce to zero the differences between the output of each cylinder. This control loop comprises a speed difference calculator 24 which calculates the differences between the values of instantaneous engine speed representing the instantaneous angular velocity for each of the cylinders $C_1$ to $C_4$, based upon the instantaneous engine speed data $N_{in}$, and a reference instantaneous engine speed for a specific cylinder which has been predetermined as a reference cylinder. In the present embodiment, the difference between the instantaneous engine speed for a cylinder which is under consideration and the instantaneous engine speed of the cylinder immediately prior thereto is utilized. Thus, the difference data $N_{11}-N_{21}$, $N_{21}-N_{31}$, $N_{31}-N_{41}$, . . . are sequentially output from speed difference calculator 24 as difference data $D_d$. The output timings of these speed difference data are as shown in FIG. 2F. It is desirable that the instantaneous engine speed values for each of the cylinders become identical, i.e., that the value of difference data $D_d$ becomes zero. For this reason, the difference data $D_d$ is added in adder 25 to the reference data $D_r$ which is zero with the polarities shown in drawing. The result of this addition operation are output as control data $D_0$, whose dimension is the fuel injection amount, after undergoing the requisite processing for PID control by third PID calculator 26. The average speed data $\overline{N}$ is updated each time new instantaneous engine speed data $\overline{N}$ is output from the speed detector 8. Thus, the contents of data $\overline{N}$ will be as shown in FIG. 2G, i.e., will vary in the sequence $N_1$, $N_2$ . . . .

Output controller 27 serves to control the output timings of control output data $D_0$ based upon the difference data $D_d$. These output timings are controlled, as described in the following, in accordance with the discrimination data $D_i$.

The control output data $D_0$ produced at any particular timing will be based upon difference data relating to two of the cylinders, $C_i$ and $C_{i+1}$. Control output data $D_0$ is produced at a value such as to control the fuel adjustment operation subsequent to combustion in cylinder $C_{i+1}$. Data $D_0$ is added to the idle amount data $Q_{ide}$ which is output from first PID calculator 14 at that time, in adder 15. Thus, for example, the difference data $N_d(=N_{11}-N_{21})$ for timing $t_4$ will express the instantaneous engine speed difference between cylinders $C_1$ and $C_2$. Data $D_0$ will therefore be output at a time which is at least slightly prior to timing $t_{11}$ at which cylinder $C_2$ next begins the power stroke, and subsequent to a timing $t_9$ at which combustion begins in cylinder $C_1$. Thus, in this case, the control data $D_0$ which is based on the difference $N_{11}-N_{21}$ is added to the idling amount control data $Q_{ide}$ which corresponds to the average speed data $\overline{N}_3$. As a result, position control of injection amount regulating member 17 is executed in a manner which tends to reduce the preceding speed difference $N_{11}-N_{21}$ towards zero, that is to say control is performed so as to cause the values of instantaneous engine speed for cylinders $C_1$ and $C_2$ to become identical.

In the same way as described above, the output controller implements control to reduce the speed difference between cylinders $C_2$ and $C_3$, the difference between cylinders $C_3$ and $C_4$, and that between cylinders $C_4$ and $C_1$, respectively towards zero. The operation in each case is identical to that whereby the difference for cylinders $C_1$ and $C_2$ is reduced to zero. In this way, control is successively performed for each cylinder such as to reduce the amount of fuel supplied to the cylinders in a manner tending to make the outputs from the cylinders become mutually identical.

A switch 29 which is controlled to be set to the on or off state by a loop controller 28 is connected at the output of the output controller 27. The switch 29 is set to the closed state, thereby implementing individual cylinder control as described above, only when the loop controller 28 detects that predetermined conditions have been satisfied which indicate that control of each cylinder can be performed in a stable manner. When these conditions are satisfied, the loop controller 28 produces a switch control signal $S_3$, whereby the switch 29 is closed. However if these predetermined conditions are not satisfied, then the switch control signal $S_3$ will hold the switch 29 in the open state, whereby individual cylinder control is inhibited. In this way, instability of idling operation resulting from cylinder control will be effectively prevented. In addition, in this embodiment, in order to improve the response characteristic, at the same time as the switch 29 is closed by the loop controller 28, the frequency of pulse signal PS which is output from the pulse width modulator 21 becomes changed to a specific frequency which is free of the effect of the speed of rotation of the diesel engine 3.

In order to perform control of angular speed of rotation by individual cylinder control as described above, it is desirable that the idling speed of rotation shall have attained a stable value which is within a specific range of speeds with respect to a desired target speed value. This is in order to ensure that good individual cylinder control will be achieved, in the manner described above, only in the event that the change in an engine speed due to the dispersion of the fuel injection system and the internal combustion engine occurs in a regular periodic fashion. If individual cylinder control were to be carried out during engine acceleration, or when some abnormality has arisen in the control system, instability of idling operation would result.

With the present embodiment of the invention, therefore, the following conditions must be satisfied before cylinder control is executed. Firstly, the difference between the target idling speed of rotation and the actual idling speed of rotation must always remain no greater than a predetermined value $a_1$ during a predetermined time interval. Secondly, the amount of actuation of the accelerator pedal must be less than a predetermined value $a_2$. Only when both of these conditions are satisfied will switch 29 be closed, to configure the control loop which performs individual cylinder control.

On the other hand, if at least one of the following conditions occurs, the switch 29 will be opened, and individual cylinder control will be terminated. These conditions are, firstly, that the difference between the target idling speed of rotation and the actual idling speed of rotation has become higher than a predetermined value $a_3$ (where $a_3 \geqq a_1$); secondly, that the degree of accelerator pedal actuation has exceeded a predetermined value $a_4$ (where $a_4 \geqq a_2$); thirdly, that some form of abnormality has developed in the control system. When the switch 29 is opened, in such a case, then closed loop control is thereafter only performed to control the injection amount regulating member 17 in accordance with average speed data in such a manner as to bring the idling speed of rotation to the predetermined target value.

In the embodiment of FIG. 1, provision is also made for operation in cold areas, just after the engine is started when the engine coolant temperature is approximately the same as the temperature of the environment. In this case, a cylinder control cut-out unit 30 acts to temporarily halt individual cylinder control operation using output data $D_0$, until the engine coolant temperature has reached a predetermined value, in order to ensure stable control of the idling speed of rotation.

The cylinder control cut-out unit 30 consists of a switch 31 which is connected in series with switch 29, a coolant temperature sensor 32 which outputs a coolant temperature signal $S_7$ to indicate the temperature of the coolant in the diesel engine 3, and a switch control circuit 33 which controls the opening and closing of the switch 31. Specifically, the switch control circuit 33 judges whether the coolant temperature $T_w$ indicated by coolant temperature signal $S_7$ is greater or less than a predetermined value $T_r$, and acts to close the switch 31 if $T_w \geqq T_r$ or to open the switch 31 if $T_w$ is less than $T_r$. Thus, if the engine coolant temperature $T_w$ is lower than the predetermined value $T_r$, the switch 31 is closed so that, irrespective of the operational status of the switch 29, supply of output data $D_0$ to the adder 15 is inhibited, and individual cylinder control is set to a cut-off condition.

When the engine temperature is low, fuel combustion conditions within the cylinders are unstable and the outputs from the cylinders will fluctuate in an irregular manner. Thus, the pattern of variation of output differences from the cylinders will not be constant. In such a case, when the preconditions for satisfactory cylinder control operation are not satisfied, cylinder control is cut off. Control under such circumstances is only carried out to make the average speed of rotation approach the predetermined target value, based upon the average engine speed value. In these conditions, more stable control of the engine idling speed can be achieved if individual cylinder control operation is not performed.

When the engine coolant temperature has risen to the value $T_r$, whereby the fuel combustion conditions within the cylinders will have stabilized, switch 31 is closed so that individual cylinder control operation is executed, as described hereinabove. Idling operation of the diesel engine 3 thereafter takes place with extremely stable control of the engine speed of rotation, a low level of fuel consumption, and low noise emission.

As described above, when both of the switches 29 and 31 are closed, a closed loop is formed to execute individual cylinder control, whereby diesel engine 3 is set in a highly stable idling operating status. Thus, if the same levels of vibration and noise emission as when individual cylinder control is not performed are permissible, then it is possible to operate the diesel engine 3 at a lower speed of rotation.

Based on the principles described above, when switches 29 and 31 are both closed so that a closed loop is formed to execute individual cylinder control operation, then the apparatus 1 functions to compensate the target speed data $N_t$ by means of the data modifying unit 36, so as to convert data $N_t$ into data which expresses an idling rotation speed value which is lower by a precisely predetermined amount. In this way, adjustment to produce a low idling speed is performed. To carry out this function, the data modifying unit 36 comprises a data output circuit 35 and an adder 34. Data output circuit 35 receives as inputs the switch control signals $S_3$ and $S_4$, and judges whether or not switches 29 and 31 are simultaneously in the closed state on the basis of said signals $S_3$ and $S_4$. If it is found that both of these switches 29 and 31 are closed, then data output circuit 35 produces as output the predetermined compensation data $D_s$. If it is found that at least one of these switches is open, then data output circuit 35 terminates the output of data $D_s$. Adder 34 serves to add the compensation data $D_s$ to the target speed data $N_t$, with the polarities shown in the drawing. Thus, if at least one of the switches 29 and 31 is in the open state, no compensation data $D_s$ will be output, so that no compensation of the target speed data $N_t$ will be performed. In such a case target speed data $N_t$ will therefore be output from adder 34 without change, to be input to adder 13. Thus no change in the target idling speed of rotation takes place. On the other hand, if switches 29 and 31 are simultaneously closed, a predetermined value of compensation data $D_s$ is subtracted from the target speed data $N_t$, whereby the average idling speed of rotation (as indicated by the data which is input to adder 13) becomes smaller by an amount equal to the compensation data $D_s$. In this way, adjustment to produce a low idling speed of rotation is executed by the control system shown in FIG. 1. An improvement in fuel consumption during idling operation is thereby achieved, and a substantial saving in fuel costs can therefore be attained.

The configuration of the embodiment described above is such that during cylinder control operation, the idling speed of rotation of the engine is lowered in a stepwise manner, in steps which correspond to the compensation data $D_s$. However it is equally possible to arrange that, when it is detected that switches 29 and 31 are both closed, the target idling speed of rotation is lowered towards a predetermined target speed with the passage of time, either in a stepless manner or in a plurality of steps.

As described in the above, the apparatus 1 is constructed such that the control data $D_0$ is supplied to adder 15 and individual cylinder control operation thereby executed only in the event that predetermined conditions for operation of the diesel engine 3 are satisfied. In order to ensure that individual cylinder control operation will be smoothly restarted in the event that it has been temporarily switched off and then switched back on, a data holding unit 50 serves to hold integral value data for integral control, which has been calculated by the third PID calculator 26. The data holding unit 50 receives as input the detection output signal $S_6$ which is produced from a cylinder control detector 39. The cylinder control detector 39 is provided to detect whether or not individual cylinder control is being performed on the basis of switch control signals $S_3$ and $S_4$ and the detection output signal $S_6$ represents the result of the detection by the cylinder control detector 39. When individual cylinder control is switched from the on to the off state, the integral value data which was produced immediately prior to that switching is held in data holding unit 50. When individual cylinder control is subsequently switched from the off to the on state, the integration value data held in data holding unit 50 is applied as initial value data to third PID calculator 26, for integral control.

Accordingly, even if individual cylinder control is temporarily set to the off state, the last integration value data to be produced prior to the termination of individual cylinder control is held stored. When individual cylinder control is subsequently resumed, the stored integration value data is utilized as initial value data. In this way, the time required for cylinder control operation to reach a stable condition after control operation is resumed can be made shorter, and the control recovery characteristics are improved.

Control of the fuel injection advance angle will now be described. In order to control the fuel injection advance angle in the fuel injection pump 2, a timer 37 is provided for fuel injection pump 2, which is controlled by a timer control circuit 38. The timer control circuit 38 receives the a.c. signal AC and the needle valve lift pulse signal $NLP_1$, calculates the optimum value for the fuel injection advance angle at each instant based upon these input signals which cover all of the operating conditions of the diesel engine 3, and produces a control signal $S_5$ indicating the calculation result. The control signal $S_5$ is applied to the timer 37 whereby optimum fuel injection advance angle control is carried out for the fuel injection pump 2.

In the apparatus 1, in order to correct the fuel injection advance angle at the idling operation of the engine 3 according to whether individual cylinder operation is being performed at the idling, the timer control circuit 38 receives the detection output signal $S_6$ from a cylinder control detector 39 which is for detecting whether individual cylinder control is being carried out in response to the switch control signals $S_3$ and $S_4$.

In response to the detection output signal $S_6$, the timer control circuit 38 acts to reduce or increase the optimum fuel injection advance angle value during idling, as computed in accordance with a.c. signal AC and the needle valve lift pulse signal $NLP_1$. This increase or decrease of the optimum fuel injection advance angle is carried out in accordance with the required object thereof. For example, if it is desired to reduce the level of vibration produced by the engine, the fuel injection advance angle is delayed with respect to the optimum value thereof, by a specific amount. If it is desired to improve fuel consumption, correction is performed such that the fuel injection advance angle is advanced beyond the optimum value, by a specific amount. In this way, when individual cylinder control is being executed, the fuel injection advance angle is adjusted to achieve a significant improvement in the control characteristic of the idling operation.

In the embodiment described above, the switch 31 which opens and closes in accordance with the coolant temperature is provided separately from the switch 29. However, it can be understood from the above explanation that it would be equally possible to employ a configuration whereby, for example, the switch control signal $S_4$ from the switch control circuit 33 is input to the loop controller 28. As described above, the determination of whether the coolant water temperature $T_w$ is higher than the predetermined temperature $T_r$ is included among the conditions which determine whether the switch 29 is to be opened or closed. If this is done, it is only necessary to apply the switch control signal $S_3$ to the data output circuit 35 and the cylinder control detector 39.

With the configuration described hereinabove, closed loop control is performed on the basis of the average speed of the diesel engine 3 and upon the position of injection amount regulating member 17, thereby controlling excessive changes in engine speed (e.g. undershoot, etc.). In addition, the target value of the instantaneous idling engine speed can be rapidly attained. Individual cylinder control is executed when the instantaneous idling engine speed has almost reached a stable state, whereby fluctuations in the angular velocity of the crankshaft 4 occurring due to operation of each cylinder are made identical. While individual cylinder control operation is in progress the average engine speed continues to be controlled. This average speed control function constitutes the major part of the idling engine speed control.

Furthermore, in the embodiment described above, at the same time as the switch 29 is closed by the loop controller 28, the frequency of pulse signal PS which is output from the pulse width modulator 21 becomes changed to a specific frequency which is free of the effect of the speed of rotation of the diesel engine 3. As a result, the response characteristic of the actuator 23 during individual cylinder control operation is enhanced, and in addition similar control can be carried out by the opening and closing of the switch 31 in response to actuator 23.

Furthermore, in the embodiment described above, detection of the angular velocity for each cylinder is performed on the basis of the time required for the crankshaft to rotate through 90° from the top dead center position of the compression stroke of the cylinder concerned. This enables variations in the torque produced following combustion to be most readily detected, and results in enhancement of the control characteristics.

In the case where the operation timing for each cylinder required for conducting the individual cylinder control is detected in the timing detector 10 on the basis of the a.c. signal AC and the needle valve lift pulse signal $NLP_1$, timing detection operation by the timing detector 10 becomes impossible if the needle valve lift sensor 9 malfunctions, so that it becomes impossible to carry out the said individual cylinder control operation. If this condition is not remedied, idling control becomes unstable. In order to avoid this, the apparatus 1 has a back-up timing detector 30 for detecting the operation timing in each cylinder on the basis of only the a.c. signal AC and back-up discrimination data $D_j$ indicating the result detected by the back-up timing detector 51 is applied to the switch SW.

For detecting whether or not the needle valve lift sensor 9 is in any trouble, there is provided a trouble detector 52 which receives the needle valve lift pulse signal $NLP_1$, the average speed data $\overline{N}$ and the actual position signal $S_2$. The trouble detector 52 discriminates whether the diesel engine 3 is being operated in the no-injection region on the basis of the average speed data N and the actual position signal $S_2$ when output of the needle valve lift pulse signal $NLP_1$ from the needle valve lift sensor 9 ceases, and produces a switching signal HS when the operation of the diesel engine 3 is not in the no-injection region. The switch SW is switched over from the state shown by a solid line to the state shown by a broken line in response to the application of the switching signal HS, so that the back-up discrimination data $D_j$ instead of the discrimination data $D_i$ is supplied to the speed detector 8 and the output controller 27.

Figure 4:
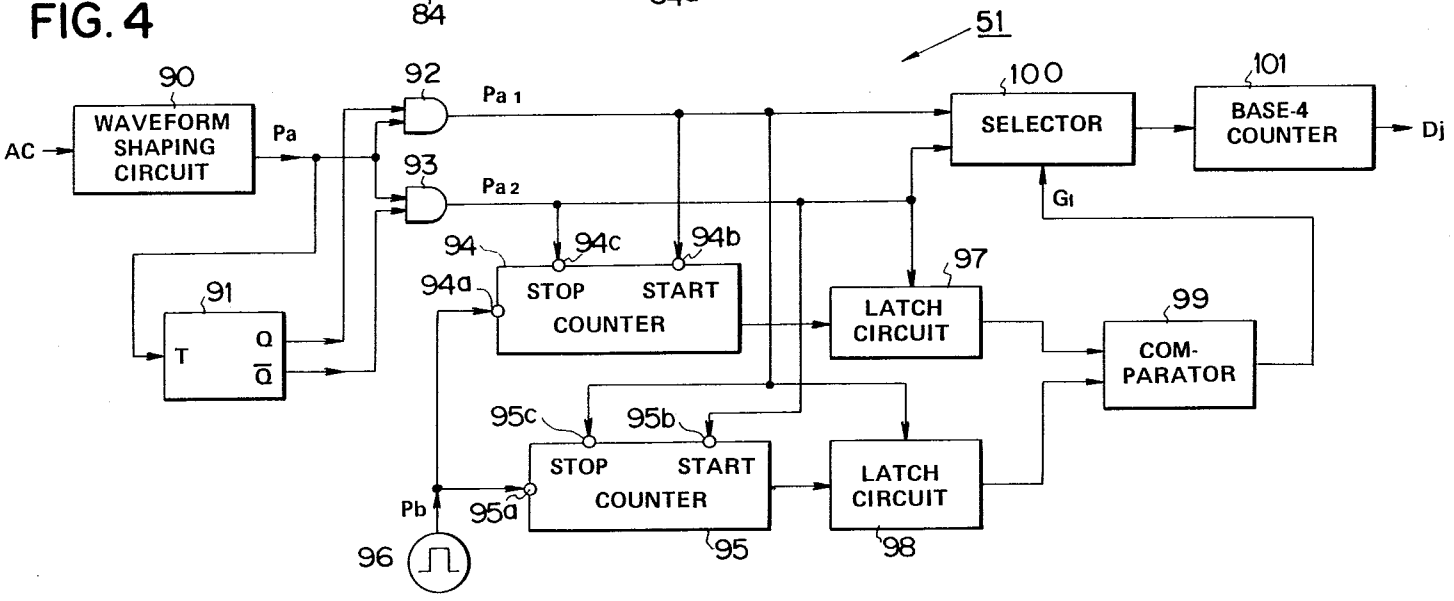
FIG. 4 is a detailed block diagram of the back-up timing detector shown in FIG. 1.
Figures 5A, 5B, 5C, 5D, 5E, 5F, 5G, 5H, 5I:
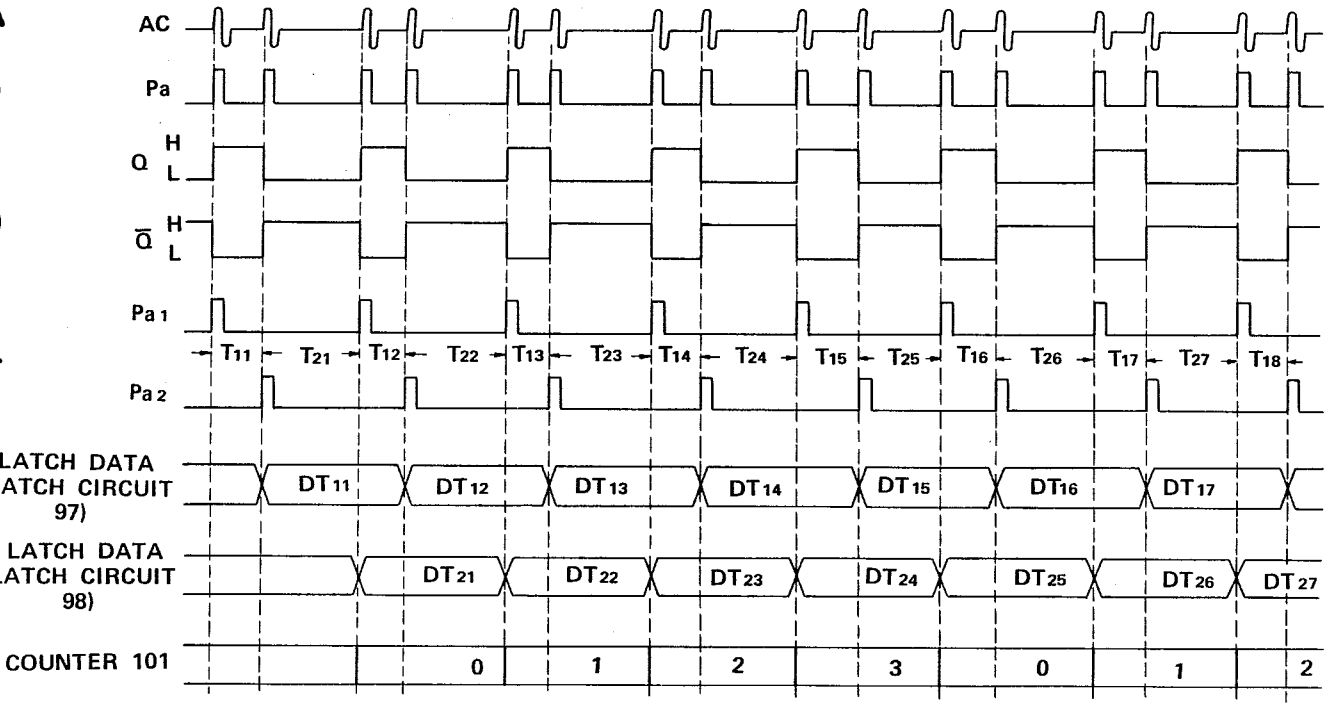
FIGS. 5A to 5I are timing charts for explaining the operation of the back-up timing detector shown in FIG. 4.

FIG. 4 is a detailed block diagram showing a circuit construction of the back-up timing detector 51. The back-up timing detector 51 has a waveform shaping circuit 90 for shaping the waveform of the a.c. signal AC (see FIG. 5A), from which a base pulse train signal $P_a$ is formed by pulses corresponding to the positive-going pulses of the a.c. signal AC. The base pulse train signal $P_a$ is applied to a T flip-flop 91 which operates in response to the timing of the leading edge of each pulse of the base pulse train signal $P_a$ to produce Q output and $\overline{Q}$ output (FIGS. 5C and 5D).

The base pulse train signal $P_a$ is applied to one input terminal of AND gates 92 and 93, the other input terminals of which receive the Q output and $\overline{Q}$ output, respectively. Therefore, the AND gate 92 is opened only when Q output is high, while the AND gate 93 is opened only when $\overline{Q}$ output is high. As a result, every other pulse of the pulses forming the base pulse train signal $P_a$ are derived from the AND gate 92 to obtain a first pulse train signal $P_{a1}$ (FIG. 5E). On the other hand, the other pulses of the base pulse train signal $P_a$ which do not form the first pulse train signal $P_{a1}$ are derived from the AND gate 93 to obtain a second pulse train signal $P_{a2}$ (FIG. 5F).

Therefore, as described hereinbefore, the top dead center timing of the pistons just before the power stroke in each cylinder can be indicated by the pulses of the pulse train signal derived from either of the AND gates 92 and 93. As will be easily understood from FIG. 5A or 5B, in this case, the pulses of the first pulse train signal $P_{a1}$ indicate the timing of top dead center of the pistons just before the power stroke of a cylinder. To discriminate the matter described above on the basis of the difference in time interval between the two serial pulses of the base pulse train signal $P_a$ without the use of the needle valve lift pulse signal $NLP_1$, there are provided counters 94 and 95 which are controlled by the first and second pulse train signals $P_{a1}$ and $P_{a2}$. These counters 94 and 95 have the same construction as that of the counter 82 shown in FIG. 3. Count pulses $P_b$ produced by a pulse generator at a sufficiently short period, as compared with that of the a.c. signal AC, are applied to input terminals $\mathbf{94}_a$ and $\mathbf{95}_a$. The first pulse train signal $P_{a1}$ is applied to a start terminal $\mathbf{94}_b$ of the counter 94 and a stop terminal $\mathbf{95}_c$ of the counter 95 and the second pulse train signal $P_{a2}$ is applied to a stop terminal $\mathbf{94}_c$ of the counter 94 and a start terminal $\mathbf{95}_b$ of the counter 95. Therefore, the counter 94 is reset by a pulse of the first pulse train signal $p_{a1}$ to start the counting operation for counting the number of the count pulses $P_b$ generated. After this, the counting operation of the counter 94 is stopped in response to the first generation of a pulse of the second pulse train signal $P_{a2}$ thereafter and the content of the counter 94 is maintained. The output data from counter 94 is applied to a latch circuit 97 for latching its input data in response to the second pulse train signal $P_{a2}$, so that the counted result of the counter 94 is immediately latched by the latch circuit 97.

The counter 95 starts to count in response to pulses of the second pulse train signal $Pa_2$ and stops counting in response to a pulse of the first pulse train signal $P_{a1}$. The counted result of the counter 95 is latched in the latch circuit 98 in response to a pulse of the first pulse train signal $P_{a1}$.

Therefore, the counter 94 produces data $DT_{11}$, $DT_{12}$, $DT_{13}$, corresponding to time $T_{11}$, $T_{12}$, $T_{13}$, . . . respectively, each of which indicates the time from a pulse of the first pulse train signal $P_{a1}$ to the next pulse of the second pulse train signal $P_{a2}$, and these data are latched by the latch circuit 97 at the time described above (see FIGS. 5E, 5F and 5G). Similarly, the counter 95 produces data $DT_{21}$, $DT_{22}$, $DT_{23}$, ... corresponding to time $T_{21}$, $T_{22}$, $T_{23}$, . . . , respectively, each of which indicates the time from a pulse of the second pulse train signal $P_{a2}$ to the next pulse of the first pulse train signal $P_{a1}$, and these data are latched by the latch circuit 98 at the time described above (see FIGS. 5E, 5F and 5H).

The data latched by the latch circuits 97 and 98 are applied to a comparator 99 which discriminates which is the lesser data. Data $G_1$ indicating the result of the discrimination is applied as a select control data to a selector 100 which receives the first and second pulse train signals $P_{a1}$ and $P_{a2}$. The selector 100 is for selectively deriving either the first pulse train signal $P_{a1}$ or second pulse train signal $P_{a2}$ in such a way that a pulse train signal which is applied as a latch signal to the latch circuit latches the latch circuit with the larger data. In this case, since the content latched by the latch circuit 98 is greater than the content latched by the latch circuit 97, the first pulse train signal $P_{a1}$ which is applied to the latch circuit 98 is selected by the selector 100, and is applied as a count pulse signal to a base-4 counter 101. That is, it follows that a pulse train signal formed of pulses showing top dead center timing of the piston just before the power stroke of the cylinder is selected on the basis of the counts of the counters 94 and 95.

Consequently, the count of the base-4 counter 101 is incremented by one at each pulse of the first pulse train signal $P_{a1}$ as shown in FIG. 5I and repeats the count from 0 to 3. As a result, the output data from the base-4 counter 101 indicates in which cylinder the piston is on its combustion stroke at that time, and is produced as the back-up discrimination data $D_j$.

It is impossible to indicate in which of the cylinders $C_1$ to $C_4$ is the power stroke occurring, just on the basis of the content of the back-up discrimination data $D_j$. However, as will be understood from the above description, individual cylinder control is not impeded and can be carried out normally by the use of the back-up discrimination data $D_j$.

Thus, it is possible to carry out the individual cylinder operation normally, even if the needle valve lift sensor 9 malfunctions.

In this embodiment, the back-up system is arranged in such a way that the back-up discrimination data $D_j$ is provided to the control system only when the needle valve lift sensor 9 malfunctions. However, the circuit shown in FIG. 4 can be provided instead of the timing detector 10 and the discrimination data from the circuit shown in FIG. 4 be constantly supplied to the speed detector and the output controller 27.

Figure 6:
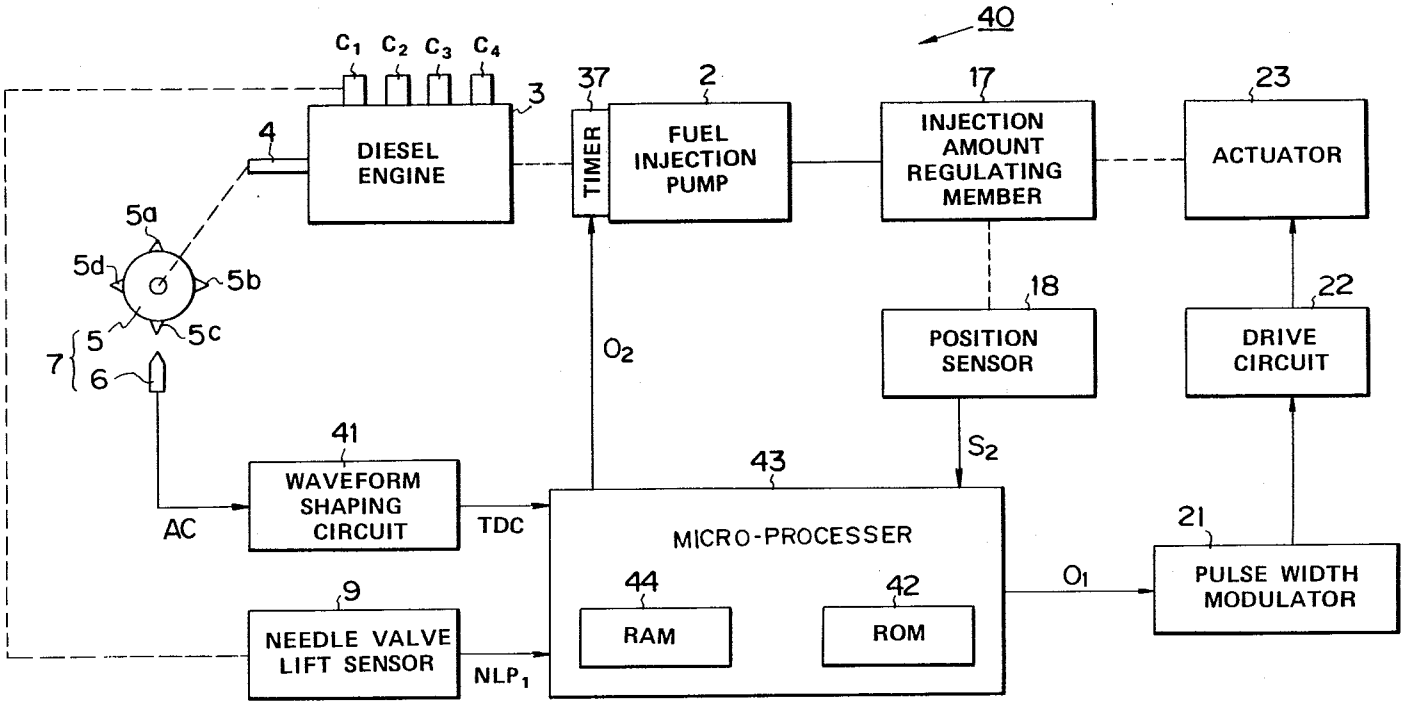
FIG. 6 is another embodiment of the present invention employing a microprocessor.

FIG. 6 shows another embodiment of the present invention, in which the idling operation control apparatus is implemented by a microcomputer or microprocessor. Those parts of the idling operation control apparatus 40 shown in FIG. 6 which are identical to the corresponding portions shown in FIG. 1 are indicated by identical reference numerals to those of FIG. 1, and further description of these will be omitted. Numeral 41 denotes a waveform shaping circuit, which produces output pulses corresponding to the positive-going pulses of a.c. signal AC. These pulses are output as top dead center pulses TDC. The TDC pulses, the needle valve lift pulse signal $NLP_1$ from needle valve lift sensor 9 and the actual position signal $S_2$ from position sensor 18, are applied to a microprocessor 43, which is equipped with a read-only memory (ROM) 42. The ROM 42 stores a control program therein, which performs an identical function to the idling control functions of the apparatus shown in FIG. 1. This control program is executed by microprocessor 43, thereby performing the control to produce a specific idling rotation speed. This control program is also designed to control injection advance angle, the microprocessor 43 producing a first output signal $O_1$ indicating the results of calculation to control the injection amount and a second output signal $O_2$ which indicates the results of calculation to control the fuel injection advance angle. The signals $O_1$ and $O_2$ are supplied to the pulse width modulator 21 and the timer 37, respectively.

Figure 7:
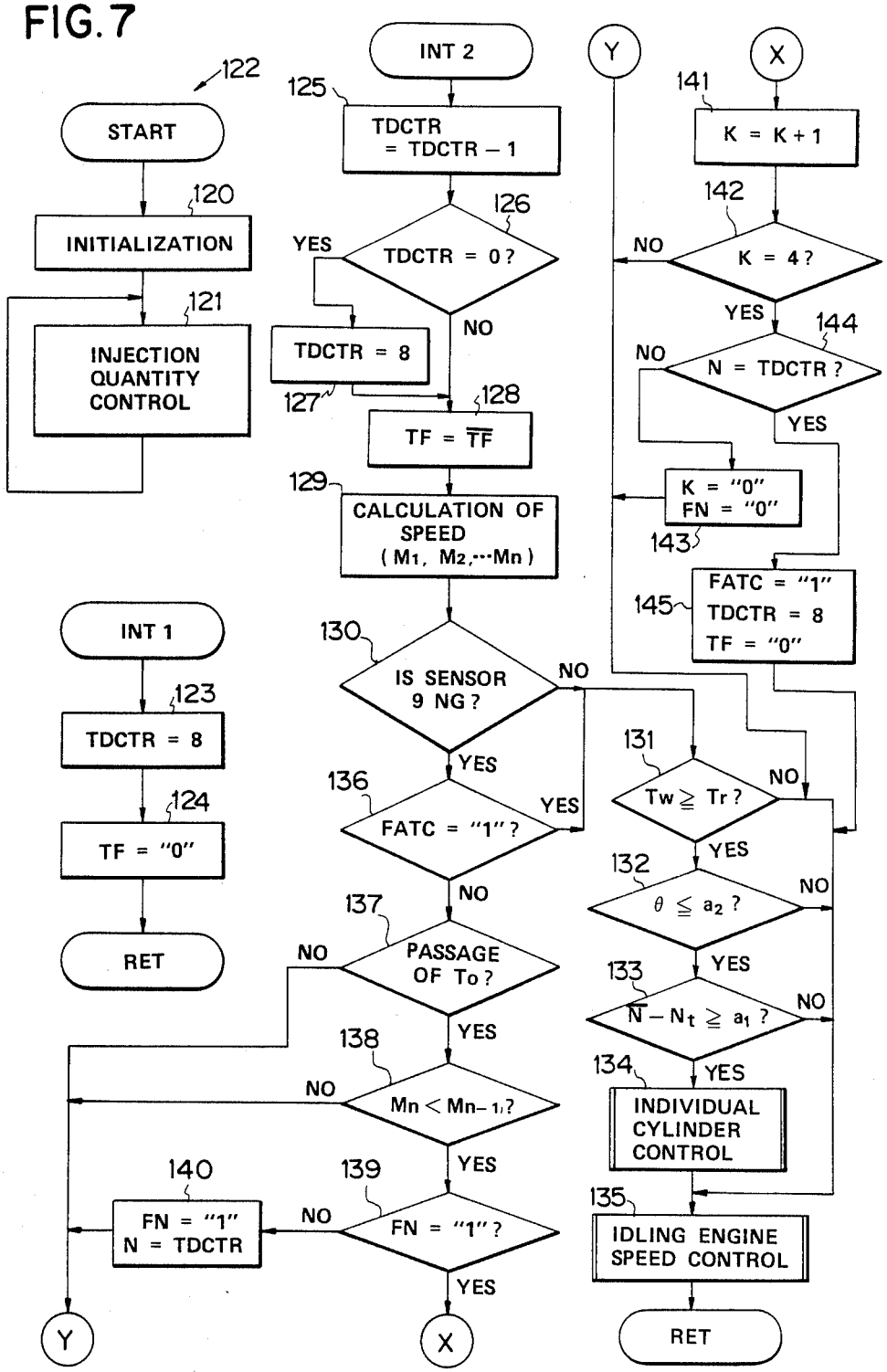
FIG. 7 is a flow chart showing a control program executed in the microprocessor in the apparatus shown in FIG. 6.

FIG. 7 shows a flow chart of the control program to be stored in the ROM 42. The control program consists of a main control program 122 having a step 120 in which operation is initialized after the start of the program and a step 121 for carrying out position control of the injection amount regulating portion as well as the calculation of a target fuel injection amount in accordance with the operation of an accelerator, an interrupt program INT 1 to be executed in response to the output of needle valve lift pulse signal $NLP_1$, and another interrupt program INT 2 to be executed in response to the output of a top dead center pulse TDC.

In the step 123 of the interrupt program INT 1, first the content of a counter TDCTR is set at 8, and a flag TF is set at "0" in step 124, terminating the execution of the operation. The flag TF is for determining if the calculation of the fuel injection amount data $Q_i$ should be performed or the data $Q_i$ being calculated should be produced in an interrupt program INT 2. The interrupt program INT 2 is executed in response to the generation of the top dead center pulse TDC and the content of the counter TDCTR is decremented by one in step 125. The operation then moves to step 126, where a first decision is made as to whether the content of the counter TDCTR is equal to zero. If the decision is YES, that is TDCTR $=0$, the operation moves to step 127, where the counter TDCTR is set at 8, and then to step 128 where inversion of the flag TF is carried out.

On the other hand, if the decision in step 126 is NO, operation moves straight to step 128, where the inversion of the flag takes place. Calculation of data $M_1$, $M_2$, . . . indicative of the time interval between adjacent pulses (which correspond to the time $T_{11}$, $T_{21}$, $T_{12}$, . . in FIG. 5) is carried out and the engine speed is calculated in step 129 in accordance with the result of the calculation.

In step 130, another decision is made as to whether the needle valve lift sensor 9 is defective or malfunctioning. The decision is made in such a manner that when the content of the counter TDCTR is larger than the predetermined value of 8 and a fuel injecting condition is detected, it is determined as having failed (NG). If the needle valve lift sensor 9 is not in an NG condition, the operation moves to steps 131 to 133, where, respectively, a decision is made as to whether the coolant temperature $T_w$ of the engine 3 is above a predetermined value of $T_r$, a decision is made as to whether the operation amount $\theta$ of the accelerator pedal is below a predetermined value of $a_2$, and whether the difference $\overline{N}-N_t$ between the target idling engine speed $N_t$ and the average idling engine speed $\overline{N}$ is above a predetermined value of $a_1$ for a predetermined time period.

Only if the decision in each of the steps 131 to 133 is YES does the operation move to step 134, where the calculation for individual cylinder control is carried out in accordance with the instantaneous engine speed for the idle operation, and step 135, where the idling engine speed is controlled on the basis of the result of the calculation for the individual cylinder control in accordance with the average engine speed.

On the other hand, when the decision is NO in any one of the steps 131 to 133, no calculation for individual cylinder control is carried out in the step 132, and only the idling engine speed control is executed based on the average engine speed.

When the coolant temperature is low, the combustion within the engine does not present the same kind of characteristics as when the combustion is not stable, and the amplitude of the output torque becomes unstable. As a result, it cannot be guaranteed that the periodic fluctuations of the combustion will have the same tendency in each cylinder, which is a prerequisite of the individual cylinder control. Thus, the temperature condition of the coolant is considered to be one of the factors for deciding the prerequisite in case of control of the individual cylinder. Accordingly, the condition of $T_w \geqq T_r$ is chosen for the individual cylinder control. When $T_w \leqq T_r$ obtains in the above case, no calculation for the individual cylinder control is executed in step 134, only the idling engine speed control based on the average engine speed being carried out.

Figure 9:
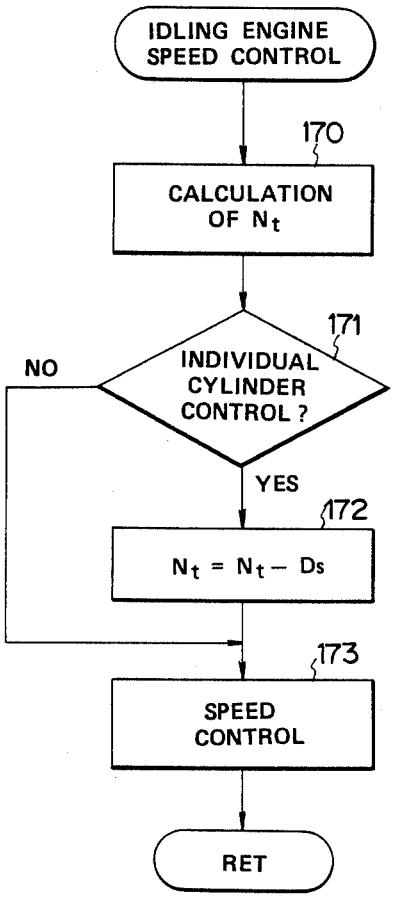

FIG. 9 shows a detailed control flow chart of the idling engine speed control to be executed in step 135. Referring to FIG. 9, in step 170 the target speed data $N_t$ is calculated, and operation moves to step 171, where a decision is made as to whether individual cylinder control is in an executable condition. If the decision is YES, the operation moves to step 172, in which is set up a target idling engine speed $N_t$ obtained by subtracting from the target engine speed data $N_t$ correction data $D_s$ indicative of a predetermined value of the engine speed data, for when executing the control in order to obtain the target idling speed lower than the target idling speed obtained in the step 170.

Figure 10:
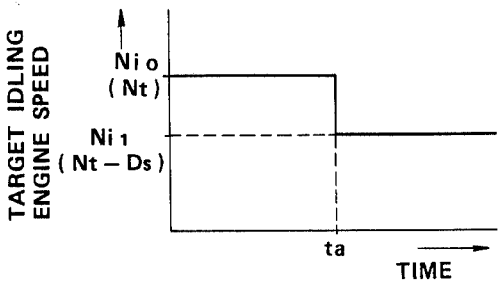
FIG. 10 is a characteristic curve for explaining the calculation for the change of a target idling engine speed.
Figure 11:
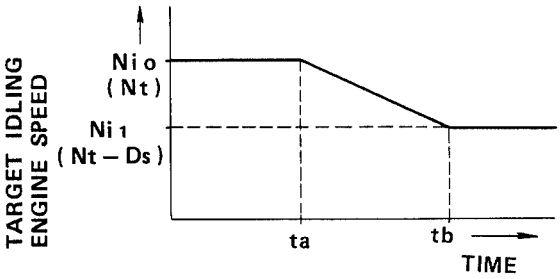
FIG. 11 is another characteristic curve showing another example of the change characteristic of the target idling engine speed.

The calculation made in step 172, therefore, the target idling engine speed at time point $t_a$ when the result of the decision in step 171 was YES can modify the original speed $N_{io}$ indicated by the data $N_t$ to an engine speed $N_{il}$ which has been reduced and indicated as data $N_t - D_s$, as shown in FIG. 10. The modification of the data in this case, however, may be constituted as a program in which the target idling engine speed is linearly reduced after time point $t_a$ described above and the value of data $N_t$ is gradually reduced so as to present the speed $N_{il}$ which has been reduced a predetermined amount at time point $t_b$ after the passage of time as shown in FIG. 11.

The operation now moves to step 173, where the required control is carried out to obtain the target idling engine speed which was set in step 172 on the basis of the result of the calculation of the injection amount for individual cylinder control.

If the decision in step 171 is NO, step 172 is omitted as the operation moves to step 173, where the idling engine speed control is performed in accordance with the data $N_t$ obtained in step 170.

Returning to FIG. 7, when the needle valve lift sensor 9 is defective, the operation moves to step 136, where a decision is made as to whether the flag FATC which indicates whether individual cylinder control should be carried out is set at "1". If the decision is YES, i.e., FATC="1", the operation moves to step 131, while if the decision is NO, i.e., FATC="0", the operation moves to step 137. In step 137, another decision is made as to whether idling operation condition has continued for a time greater than a predetermined time of $T_0$. If the decision is NO, the operation moves to step 135, while if the decision is YES, the operation moves to step 138.

In step 138, among data indicative of the time interval between successive top dead center pulses TDC, the data $M_n$ obtained in the current execution of the interrupt program INT 2 is compared with the data $M_{n-1}$ which was obtained in the execution of the interrupt program INT 2 one time previous for large or small. As will be appreciated from FIGS. 2A and 2B the intervals between top dead center pulses TDC alternate between a long state and a short state so that the comparison of the data $M_n$ with the data $M_{n-1}$ makes it possible to determine if the operation timing for the cylinders is in the long state or the short state.

In this case, if the condition $M_n < M_{n-1}$ is obtained, the top dead center pulse TDC by which the interrupt program INT 2 is executed at this time is the first pulse produced after one ofthe cylinders enters its power stroke. That is, it corresponds to any of the timings $t_2$, $t_4$, $t_6$, . . . .

On the other hand, if the condition $M_n \geqq M_{n-1}$ is obtained, the top dead center pulse TDC by which the interrupt program INT 2 is executed at this time is a pulse indicating the start of the power stroke in any of the cylinders of the engine. That is, it corresponds to any of the timings $t_1$, $t_3$, $t_5$, . . . .

Accordingly, when the decision in step 138 is NO, no calculation of the injection amount for individual cylinder control is performed and the operation moves to step 135, while if the decision is YES, the operation moves to step 139, where it is decided whether the flag FN is set at "1". The flag FN is provided for discriminating whether the decision in step 137 become YES at least once.

When the flag FN is "0", the decision in step 139 is NO and the operation moves to step 140, where the flag FN is set to "1" and the content of the counter TDCTR is set at a variable N, and the operation moves to step 141. Accordingly, from next time the decision in step 139 becomes YES. In step 141, $K=K+1$ is established, and a decision is then made as to whether K is equal to 4, i.e., K=4, in step 142. When any of the cylinders enters its power stroke, K increases by one. If the decision in step 142 is NO, the operation moves to step 135. However, if the decision in step 142 is YES, the operation moves to step 144, where another decision is made as to whether the variable N is equal to the content of the counter TDCTR. When N=TDCTR obtains, because one cycle has elapsed, i.e., the crankshaft 4 has rotated 720 degrees, the operation moves to step 145 where FATC ="1", TDCTR=8, and TF ="0" are set, and the operation moves to step 135. On the other hand, when the decision in step 144 is NO, the operation moves to step 143, where K="0" and FN=0 are established, and the operation then moves to step 135.

As described in the above, when the needle valve lift sensor 9 is detected as not having failed the operation moves directly to step 131. However, when the needle valve lift sensor 9 is malfunctioning, the data $M_{n-1}$ are compared with $M_n$ and a decision on operation timing for each of the cylinders of the engine is made. Step 134 for calculating the injection amount for each cylinder is then executed in accordance with the result of the decision.

Figure 8:
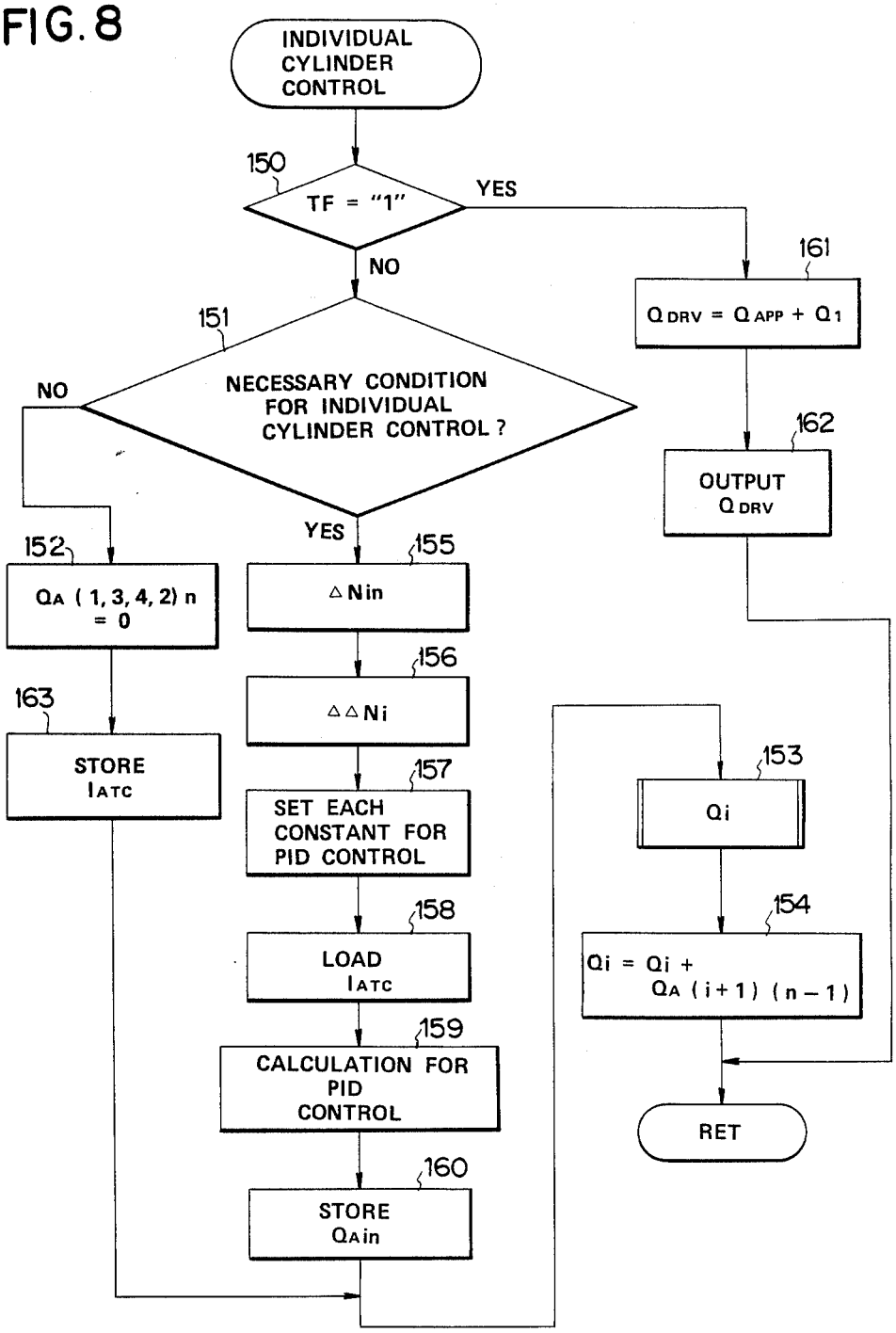
FIGS. 8 and 9 are detailed flow charts showing a part of the flow chart shown in FIG. 7.

The control and operation for the individual cylinders in step 134 will now be explained with reference to the detailed flow chart shown in FIG. 8.

First, in step 150 the status of the flag TF is discriminated. If it is determined that TF="0", the subsequent steps for calculating the control data for each of the cylinders are executed. On the other hand, if it is determined that TF="1", the subsequent steps for deriving the control data for controlling the cylinders are executed. The status of the flag TF=0 means the condition where the top dead center pulse TDC has not yet been produced after the needle valve lift pulse signal $NLP_1$ was produced, or a condition where an even number of the top dead center pulses TDC have been already produced after the needle valve lift pulse signal $NLP_1$ was produced, but the next top dead center pulse TDC has not yet been produced. Namely, the status indicates a time period during which the cylinder has not entered the power stroke and it corresponds to each of the time periods $t_2$ to $t_3$, $t_4$ to $t_5$, $t_6$ to $t_7$, . . . in FIG. 2.

On the other hand, the status of the flag TF="1" indicates the time periods during which any one of the cylinders is in the combustion process as will be understood from the foregoing description. The time periods correspond to each of the time periods $t_1$ to $t_2$, $t_3$ to $t_4$, $t_5$ to $t_6$, . . . FIG. 2.

When the flag TF is "0", the operation moves to step 151, where a decision as to whether the operation conditions of the engine satisfy the necessary conditions for enabling the individual cylinder control to be carried out. If the decision is NO, the contents of the data indicative of the fuel injection amount $Q_{Ain}$ for individual cylinder control are made zero in step 152. In the description of this specification, the fuel injection control data for controlling each of the cylinders is indicated as $Q_{Ain}$ in general, where i indicates cylinder number and n indicates the timing calculated form the data.

After this operation, in step 163, the integral control data $I_{ATC}$ for performing the integral control is stored among the results of the calculation for the PID control. This PID control is executed in step 159, as will be described later. The integral control data obtained in step 159 just before the individual cylinder control is turned OFF is stored in a random access memory (RAM) 44 of the microprocessor 43. After this operation, the operation moves to step 153, where the calculation for obtaining the fuel injection control amount data $Q_i$ for the idle engine speed control is carried out in accordance with the average engine speed, and operation moves to step 154.

In step 154, the injection amount control data $Q_{A(i+i)(n-1)}$ is added to the control data $Q_i$ for the next cylinder control which was calculated one cycle before. This resulting control data $Q_i$ is stored in the RAM 44 of the microprocessor 43.

If the decision in step 151 is YES, the operation moves to step 155, where the difference $\Delta N_{in}$ between the speed $N_{in}$ based on the top dead center pulse TDC output at this time and the speed $N_{(i-1)}$ based on the top dead center pulse TDC output one cycle before is calculated and the operation moves to step 156.

In step 156, from the difference $N_i$ thus obtained in step 155 and the difference $N_{i(n-1)}$ similarly obtained one cycle before, another difference $N_i$ is calculated therebetween. After this operation, each constant for performing the PID control is set up in step 157 and the operation moves to step 158, where the integral data $I_{ATC}$ for the integral control, stored in step 163, is loaded and the operation moves to step 159, where the PID control calculation is performed using each of these data. Accordingly, in the calculation of the PID control executed in step 159 when the individual cylinder control is changed from the OFF condition to the ON condition, the data which has been stored in the step 163 is used as an integral control data $I_{ATC}$. Thus, the required result can be obtained rapidly, as compared with the case where the calculation of the PID control is again carried out from the beginning, as the integral control data is zero and the transient time of the control can be greatly improved.

The control data $Q_{Ain}$ for controlling each of the cylinders, obtained by the calculation for the PID control in step 159, is stored into the RAM 44 in step 160. Accordingly, in this case, the data value which has been stored in the step 160 and the previous value of the data $Q_i$ are added together to obtain a final data $Q_i$.

On the other hand, when the decision in step 150 is YES, the data $Q_i$ at that time is added to the control data $Q_{APP}$ determined in accordance with the amount of the operation of the accelerator pedal, so as to be data $Q_{DRV}$ in step 161, and the operation moves to step 162, where the data $Q_{DRV}$ is produced as fuel injection amount control data for the cylinders in which the intake stroke is in progress.

As will be understood from the foregoing description, when the needle valve lift sensor 9 is normal, the calculation of the control data for carrying out individual cylinder control and its output are controlled by the flag TF, while when the sensor 9 is faulty, the comparison of the data $M_n$ with the data $M_{n-1}$ enables determination of the timing to be executed for the individual cylinder control. Consequently, regardless of whether the needle valve lift sensor 9 is normal or faulty, suitable operation for individual cylinder control can be carried out.

Figure 12:
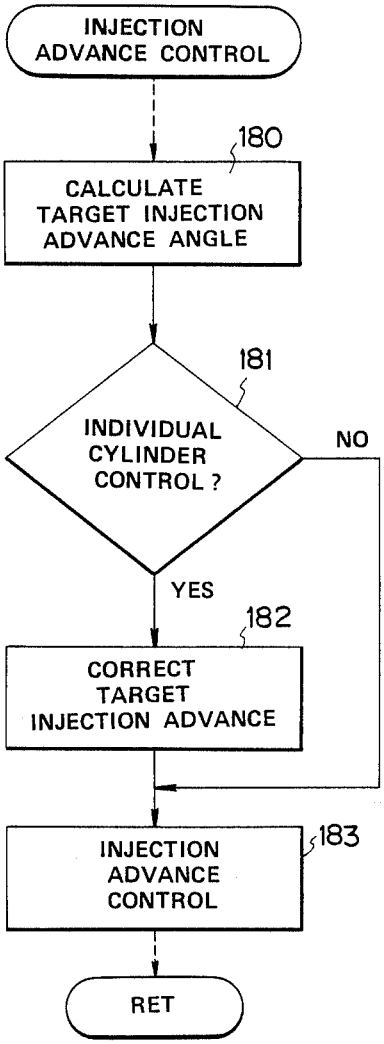
FIG. 12 is a detailed flow chart showing the principal steps of an injection advance angle control.

FIG. 12 shows a detailed control flow chart of a main portion of the step for the injection advance angle control shown in FIG. 7. In the figure, after starting injection advance angle control, the calculation for the advance angle target value is performed in step 180 and the operation moves to step 181, where a decision is made as to whether individual cylinder control is being executed. If the decision is YES, meaning individual cylinder control is being carried out, the operation moves to step 182, where a corrective calculation is performed so that the target advance angle value obtained in step 180 can be increased or decreased by a predetermined amount. After this operation, step 183 is executed.

In step 183, an injection advance angle control for controlling the timer 37 is carried out so that the actual advance angle is equal to the target advance angle obtained in step 182 and the injection advance angle control terminates. If the decision in step 181 is NO, however, the execution in step 182 is omitted and the target advance angle obtained in step 180 is used for the control, instead.

Accordingly, in the idle operation control apparatus for an internal combustion engine according to the present invention, the target advance angle value can be modified in accordance with whether the control for each of the cylinders is being performed, thus strikingly improving the idling operation characteristics under consideration.

Moreover, use of a memory with a battery back-up for storing the integral control data obtained in accordance with the calculation of the PID control enables the integral control data to be used when the individual cylinder control is carried out after the start of the following operation, even when a main switch is turned off, thereby providing greater convenience in the improvement of advanced cyliner control.

What is claimed is:

1. In an apparatus for controlling the idling operation of an internal combustion engine including a closed-loop control system having a first output means for producing an average speed data indicating an average engine speed of a multi-cylinder internal combustion engine, a second output means for producing a target speed data indicating a predetermined target idling engine speed, a first calculating means responsive to said average speed data and said target speed data for producing a first control data relating to the fuel amount to be supplied to said engine so as to obtain said target idling engine speed, and a controlling means responsive to said first control data for controlling a speed regulating means so as to carry out the closed loop control for the idling engine speed; comprising:

a detecting means for producing an operation timing signal of said engine;

a first means responsive to the timing signal from said detecting means for producing a first data relating to outputs of respective cylinders of said engine;

a second means responsive to said first data for repeatedly calculating and producing a differential data for each of the cylinders in succession, the differential data being indicative of the difference between the output of the respective cylinder and the output of a reference cylinder which is predetermined for each cylinder;

a second calculating means responsive to said differential data for calculating and producing a second control data relating to the fuel amount necessary for nullifying the difference indicated by the differential data;

an output control means responsive to the result of the said detecting means for outputting said second control data at a predetermined timing before the subsequent regulation of fuel for each of the cylinders; and a third means for supplying said second control data to said closed-loop controlling means, wherein said controlling means operates to control said speed regulating means in response to said first and second control data.

2. An apparatus as claimed in claim 1 wherein said detecting means has a first signal generator for generating first pulses every time the crankshaft of said engine reaches predetermined reference angular positions, a second signal generator for generating second pulses every time fuel is injected into a predetermined cylinder of said engine, and a data output means responsive to said first and second pulses for producing a discrimination data indicating which cylinder is in the combustion process.

3. An apparatus as claimed in claim 2 wherein said first signal generator generates the first pulse every time any of the pistons of said engine reaches its top dead center position.

4. An apparatus as claimed in claim 3 wherein said data output means has a counter which is reset by the second pulses and counts the first pulses, whereby the data showing the counting result in the counter is output as said discrimination data.

5. An apparatus as claimed in claim 1 wherein said detecting means has a signal generator for generating a timing pulse every time the crankshaft of said engine reaches predetermined reference angular positions, and a discriminating means responsive to the timing pulse for discriminating relative operation timing among the cylinders on the basis of the periodical change in interval in the generation of the timing pulses due to the periodical change in the instantaneous rotational speed of said engine.

6. An apparatus as claimed in claim 5 wherein discriminating means has means responsive to the timing pulses for producing a first pulse train signal formed by deriving the timing pulses from each other and a second pulse train signal formed by the residual timing pulses, a decision means responsive to the first and second pulse train signals for deciding which pulse train signal is for indicating the compression top dead center timing, a selecting means responsive to the decision in said decision means for selecting a desired pulse train signal, and an n-advance counter (n being equal to the number of the cylinders of said engine) for counting the pulses of the pulse train signal selected by said selecting means, whereby the counted data obtained by said n-advance counter is derived as said discrimination data.

7. An apparatus as claimed in claim 1 wherein said detecting means has a first signal generator for generating first pulses every time a crankshaft of said engine reaches predetermined reference angular positions, a second signal generator for generating second pulses every time fuel is injected into a predetermined cylinder of said engine, a first data output means responsive to said first and second pulses for producing a discrimination data indicating which cylinder is in the combustion process, a second data output means responsive to the first pulses for discriminating relative operation timing among the cylinders on the basis of the periodical change in interval in the generation of the first pulses due to the periodical change in the instantaneous rotational speed of said engine, a trouble detecting means for detecting whether said second signal generator is malfunctioning, means responsive to the result of said trouble detecting means for selecting either the discrimination data when no malfunction occurs in said second signal generator or the result of said second data output means when any malfunction occurs in said second signal generator.

8. An apparatus as claimed in claim 1 wherein said first means calculates data indicating angular velocity of the crankshaft of said engine each cylinder enters the combustion process, and the calculated result is derived as said first data.

9. An apparatus as claimed in claim 8 wherein said second means calculates said differential data in response to said first data on the basis of the difference in angular velocity of the crankshaft of said engine at the time of the combustion process of each cylinder.

10. An apparatus as claimed in claim 1 wherein said second output means calculates said target speed data in response to a signal showing the operating condition of said engine.

11. An apparatus as claimed in claim 1 further having a switching means for controlling the supply of said second control data to said third means.

12. An apparatus as claimed in claim 11 further having an injection advance regulating means for regulating an injection advance angle of fuel injected to said engine and means for operating said injection advance regulating means so as to change the injection advance from a predetermined optimum value by a predetermined value in response to the supply of said second control data to said third means through said switching means.

13. An apparatus as claimed in claim 11 further having means for correcting said target speed data in such a way that said predetermined target idling engine speed is decreased by a predetermined value in response to the supply of said second control data to said third means through said switching means.

14. An apparatus as claimed in claim 11 further having a temperature detecting means for detecting temperature of a coolant for said engine and means responsive to the output from said temperature detecting means for turning on said switching means when the temperature of the coolant exceeds a predetermined temperature.

15. An apparatus as claimed in claim 11 wherein said switching means is ON when the difference between the target idling engine speed and the actual idling engine speed is less than a predetermined value.

16. An apparatus as claimed in claim 11 wherein said switching means is ON when the difference between the target idling engine speed and the actual idling engine speed has been continuously less than a predetermined value for a predetermined period.

17. An apparatus as claimed in claim 11 further having a processing means for performing data processing so as to carry out at least a proportional control and an integral control for said second control data, and means responsive to the ON/OFF control of said switching means for holding the integral value data for carrying out the integral control and for providing the integral value data as initial data to said processing means so as to perform the integral control when the individual cylinder control is started, said integral value data having been used in said processing means.

* * * * *

UNITED STATES PATENT AND TRADEMARK OFFICE

CERTIFICATE OF CORRECTION

PATENT NO. : 4,742,462

DATED : May 3, 1988

INVENTOR(S) : Kyoichi Fujimori, et al.

It is certified that error appears in the above-identified patent and that said Letters Patent is hereby corrected as shown below:

Col. 1, line 23, "are generated" should read --were liable to be generated--.

Col. 3, line 14, "amount" should read --width--.

Col. 4, line 68, "begines" should read --begins--.

Col. 5, line 2, "begines" should read --begins--.

Col. 5, line 22, "follw-" should read --follow---.

Col. 18, line 12, "ofthe" should read --of the--.

Col. 21, line 12, "speed; comprising:" should read --speed; the improvement comprising:--.

Signed and Sealed this

Twenty-third Day of May, 1989

*Attest:*

*Attesting Officer*

DONALD J. QUIGG

*Commissioner of Patents and Trademarks*